US010662591B2

(12) United States Patent
Wadensten et al.

(10) Patent No.: US 10,662,591 B2
(45) Date of Patent: May 26, 2020

(54) FORWARD AND REVERSIBLE SELF-PROPELLED VIBRATORY POTHOLE PACKER

(71) Applicant: Vibco, Inc., Wyoming, RI (US)

(72) Inventors: Sven-Axel K. Wadensten, Wakefield, RI (US); Victor A. Cazares, Carlsbad, CA (US); Theodore S. Wadensten, Charlestown, RI (US)

(73) Assignee: Vibco, Inc., Wyoming, RI (US)

( * ) Notice: Subject to any disclaimer, the term of this patent is extended or adjusted under 35 U.S.C. 154(b) by 0 days.

(21) Appl. No.: 16/240,290

(22) Filed: Jan. 4, 2019

(65) Prior Publication Data

US 2019/0242074 A1 Aug. 8, 2019

Related U.S. Application Data

(60) Provisional application No. 62/613,839, filed on Jan. 5, 2018.

(51) Int. Cl.
*E01C 19/28* (2006.01)
*E01C 23/06* (2006.01)

(52) U.S. Cl.
CPC ..... *E01C 19/283* (2013.01); *E01C 19/286* (2013.01); *E01C 23/06* (2013.01)

(58) Field of Classification Search
CPC ..... E01C 19/283; E01C 19/288; E02D 3/026; E02D 3/076
USPC ..... 404/117
See application file for complete search history.

(56) References Cited

U.S. PATENT DOCUMENTS 1,650,574 A 11/1927 Stubbs
2,078,290 A * 4/1937 Sloan ..... E01C 19/283 404/117
3,038,349 A * 6/1962 Meyer ..... E01C 19/238 404/123
3,048,089 A * 8/1962 Kaltenegger ..... E01C 19/283 404/117
3,225,669 A * 12/1965 Green ..... E01C 19/282 404/117
3,383,992 A * 5/1968 Kaltenegger ..... E01C 19/283 404/117
3,415,174 A * 12/1968 Kaltenegger ..... E01C 19/286 404/117
3,431,832 A * 3/1969 Lang ..... E01C 19/283 180/342
3,554,100 A * 1/1971 Mauldin ..... E01C 19/238 404/117
3,580,147 A * 5/1971 Kaltenegger ..... E01C 19/283 404/117
3,722,380 A * 3/1973 Kaltenegger ..... E01C 19/283 404/117
4,647,247 A 3/1987 Sandstrom
(Continued)

*Primary Examiner* — Abigail A Risic
(74) *Attorney, Agent, or Firm* — Barlow, Josephs & Holmes, Ltd.

(57) ABSTRACT

A forwards and reversible vibratory pothole packer includes a rotatable eccentric element shaft; a number of pulleys and linkages connected to the shaft; the pulleys and linkages changing the direction of the shaft. As a result, clockwise direction rotation of the shaft causes the drum to rotate in a counter clockwise direction thereby providing reverse direction of the unit and also counter-clockwise rotation of the shaft causes the drum will be propelled forwards. Thus, linear motion of the unit is reversed.

7 Claims, 12 Drawing Sheets

(56) References Cited

U.S. PATENT DOCUMENTS

| | | | |
|---|---|---|---|
| 5,244,306 | A | 9/1993 | Artzberger |
| 5,480,259 | A | 1/1996 | Thrower |
| 5,803,656 | A | 9/1998 | Turck |
| 6,200,066 | B1 | 3/2001 | Humphrey |
| 6,409,425 | B1 | 6/2002 | Okabe et al. |
| 6,837,648 | B1 | 1/2005 | Wadensten |
| 7,080,955 | B2 | 7/2006 | Gregg |
| 7,588,389 | B1 | 8/2009 | Humphrey |
| 8,100,603 | B2 | 1/2012 | Sampson |
| 8,186,906 | B2 | 5/2012 | Zimmerman |
| 8,297,878 | B2 | 10/2012 | Goodman et al. |
| 8,414,220 | B1 | 4/2013 | Koba |
| 8,727,660 | B2 | 5/2014 | Anderegg et al. |

* cited by examiner

FORWARD AND REVERSIBLE SELF-PROPELLED VIBRATORY POTHOLE PACKER

CROSS REFERENCE TO RELATED APPLICATION

This application is related to and claims priority to earlier filed U.S. provisional patent application 62/613,839, filed Jan. 5, 2018, the entire contents thereof is incorporated herein by reference.

BACKGROUND OF THE INVENTION

The present invention relates to a vibratory roller. More specifically, the present invention relates to a vibratory roller that is configured for use in compacting asphalt in potholes, and that is configured to be hand-operated and to be maneuvered by a human.

Vibratory rollers are used in the construction industry, compacting sand, gravel and asphalt in the construction of roads, parking lots and driveways. There are several types of vibratory rollers. They can be divided into two general groups. The first group includes self-propelled double drum units where the operator sits on a platform operating the vibratory element as well as the forward and reverse movement, namely, the direction in which the unit is travelling. The other group is the walk-behind type where the operator walks behind the roller controlling the vibratory element as well as the forward and reverse movement of the unit. These units are in the range of several hundred to thousands of pounds in weight, and are more suitable for large road repairs rather than for small potholes. There has been a need for a smaller, easy to maneuver, and lightweight vibratory roller for small repairs and primarily for compacting asphalt in potholes.

Typically when a pothole needs to be filled, the worker will drive up to a pothole, throw down some cold or hot asphalt mix. After that the worker would drive over the hole with their truck to compact the asphalt. This is a poor practice and allows the pothole to reappear within a year due to the poor compaction. The light weight vibratory roller allows for the worker to effectively compact and patch the pothole. The roller drum provides a small surface area on the surface of the pothole, combined with a lot of force from the vibrator, which compacts the asphalt on a microscopic level. The vibratory roller is a walk behind machine which means that only one person is needed to use the unit. Previously the vibratory walk behind roller was very efficient in the forwards direction. Typically the user would compact a pothole by pushing the unit forwards over the pothole then pulling the unit backwards over the pothole. Because the previous design was only self-propelled in the forwards direction, it would put a lot of strain on the user when pulling the vibratory roller backwards. The forwards and reverse propelled vibratory unit will allow the user to patch a pothole with more efficiency while keeping the quality of the pothole patch. Why a vibratory compactor is necessary for patching potholes, as well as different pothole patching methods can be seen in the document attached labeled "VIBCO Vibrators Vibratory Roller Redesign," under section 2.2 Soil Compaction Methods. The same document also describes the issues with the single direction vibratory roller in section 2.4.2 Existing Products. The newly design forwards and reversible vibratory roller will fix this problem.

The forwards and reversible vibratory roller that is being discussed in this written document is currently protected by U.S. Pat. No. 9,234,316, Vibratory Pothole Packer. This was invented by Theodore S. Wadensten and a company called VIBCO Vibrators. Another patent invented by Theodore S. Wadensten is U.S. Pat. No. 6,837,648, Portable roller-type compactor apparatus having a combined means for the vibrating and reversible propelling thereof. This patent is similar to the unit being designed due to the fact that they are both forwards and reversible drive vibratory rollers. The patent invented by Theodore S. Wadensten (U.S. Pat. No. 6,837,648) uses an eccentric element that is external to the roller. The invention being described in this document uses an eccentric element that is internal to the drum of the unit. Also, the eccentric element does not pivot on a pivot point to deliver a forwards and backwards motion like U.S. Pat. No. 6,837,648. Instead it uses pulleys to change the rotational direction of the internal eccentric mass.

When a unit is being pulled backwards, the drum is still rotating forwards. This makes the process very tiring for the user, and it also tears up the asphalt due to the constant forwards rotation of the drum. When the unit is pulled backwards, the unit wants to jump around which creates divots and bumps in the asphalt. These divots and bumps, if not fixed, will allow water to seep through the asphalt creating more potholes. For example, FIG. 5 depicts how the drum of a prior art machine tears up the asphalt behind it when pulled backwards over a pothole.

In view of the above, there is a need for an improved pothole packer that is well-suited for smaller jobs and is easier to operate while cause less damage to the asphalt.

SUMMARY OF THE INVENTION

The present invention provides a small vibratory pothole packer, which is small and light, so the vibratory pothole packer is easily portable in a cost-effective manner between small jobs that require filling one pothole or only a few potholes.

The invention being described in this document will be used to patch potholes. The forwards and reversible design will allow the user to go in a forwards direction then a reverse direction over a pothole. This will eliminate the problems affiliated with a single direction vibratory roller which was discussed below. This vibratory roller is driven linearly due to the vibratory force from the eccentric shaft. It is a walk behind vibratory roller that is operated by one person. There is a particular need for a pothole packer that is capable of easily reversing in direction.

BRIEF DESCRIPTION OF THE DRAWINGS

The novel features that are characteristic of the present invention are set forth in the appended claims. However, the invention's preferred embodiments, together with further objects and attendant advantages, will be best understood by reference to the following detailed description taken in connection with the accompanying Figures in which:

DESCRIPTION OF THE INVENTION

A description of the forwards and reversible vibratory pothole patcher of the present invention is described in detail below. This description also as a picture of a CAD model that has specifics pointed out, as seen in FIGS. 1A and 1B.

Figure 1B:
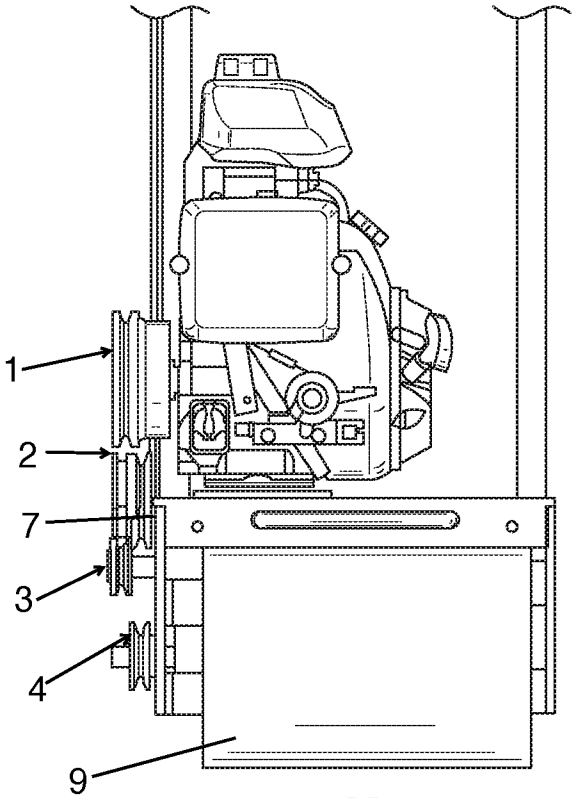
FIGS. 1A and 1B are two different views of the machine of the present invention.
Figure 1A:
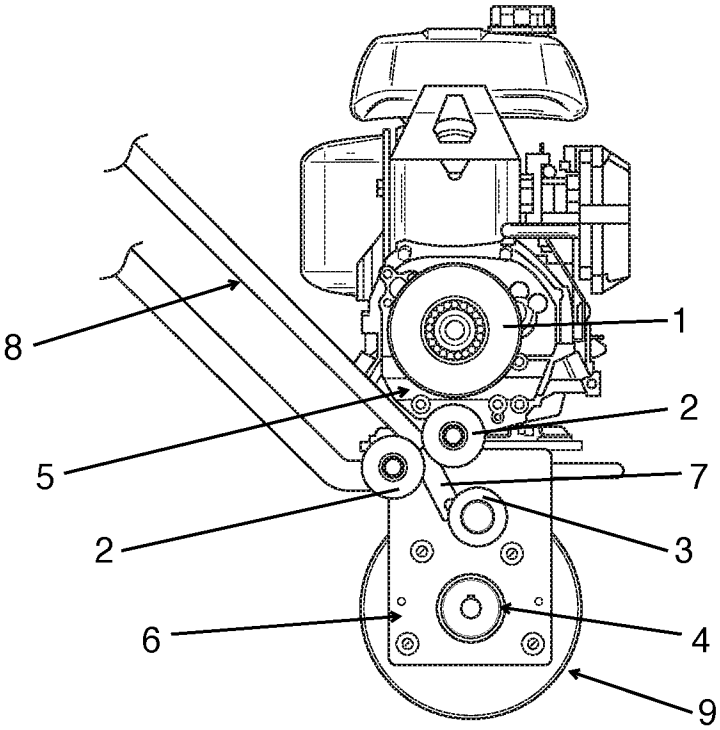

In FIGS. 1A and 1B, provided a lever to push and pull the two pulleys 2. These pulleys come in and out of contact with an engine belt 5 that runs around the engine pulley 1 and the idler pulley 3. As the two drive pulleys 2 come in and out of contact with the engine belt, the direction of rotation of the eccentric element pulley 4 and eccentric drive belt 6 changes, which then changes the direction of the linear motion of the drum 9 due to vibration forces. The drum is not directly driven by the engine. The eccentric element is driven by the engine, and the direction of rotation of the eccentric element determines which way the unit moves linearly.

Figure 2:
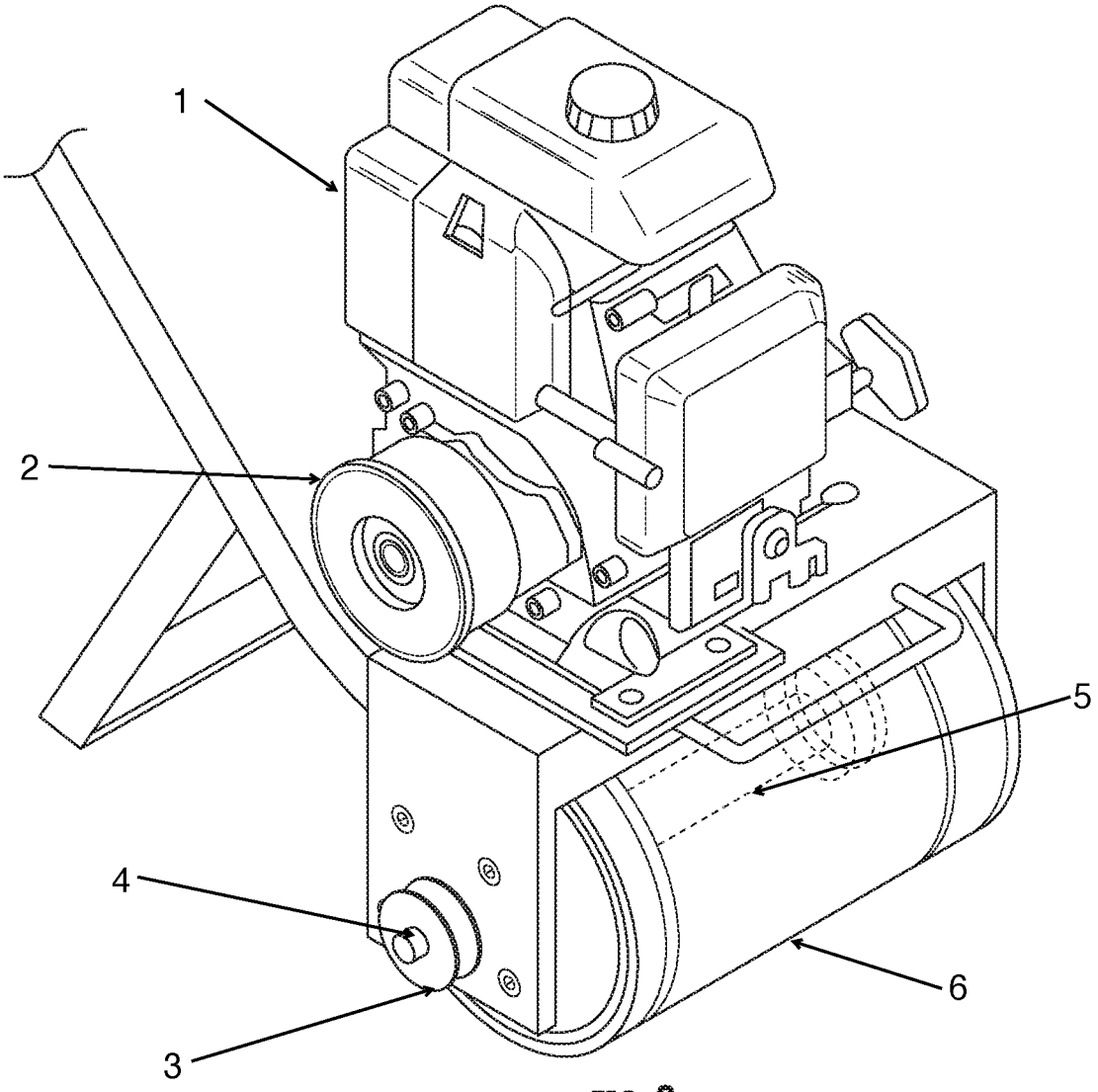
FIG. 2 is a perspective view of a prior art machine.

In FIG. 2, relevant component parts are shown and described that are used in connection with the present invention. There are many components working between the engine and the drum of the roller to create the vibration needed for compaction. FIG. 2 shows some major parts of the assembly. First, the unit is powered by a 2.5 hp Honda engine 1, which sits above the drum on a mounting plate. Attached to the engine is the driver pulley 2 which rotates at about 3400 RPM. A V-belt (not shown below) wraps around the engine pulley which connects to the eccentric pulley 3, directly below. Because of the difference in diameters, the eccentric pulley rotates at about 6500 RPM and is connected directly to the eccentric shaft 4. Welded onto the eccentric shaft is the eccentric mass 5. This shaft sits concentrically inside the drum 6 and is held in place by bearings pressed into the drum. Because of these bearings, the rotation of the drum is not driven directly by the engine. This concept will be explained in more detail in later sections. There are two key mechanical theories affecting this unit. The first is the relationship between the pulleys and V-belt, involving pulley speeds and torque transmission. The pulley speeds are dependent on the size of the pulleys used and the torque transmitted by the belt depends on the tension and contact angles of the belt. Next there is the eccentric shaft and drum. The eccentric shaft has a center of mass that protrudes from the axis of rotation (which is the eccentric mass), which causes an unbalance when it rotates. The degree of this unbalance is a product of the mass of the eccentric shaft and eccentric mass and the distance to the center of mass from the center of rotation. Then the force created by rotation is a function of the rotational unbalance and angular velocity. One last distinction to point out is the use of a rolling drum rather than a flat plate which can be seen on a plate compactor. The smaller contact area with the ground provides a higher pressure for compaction and the rolling allows for ease of use.

Figure 3:
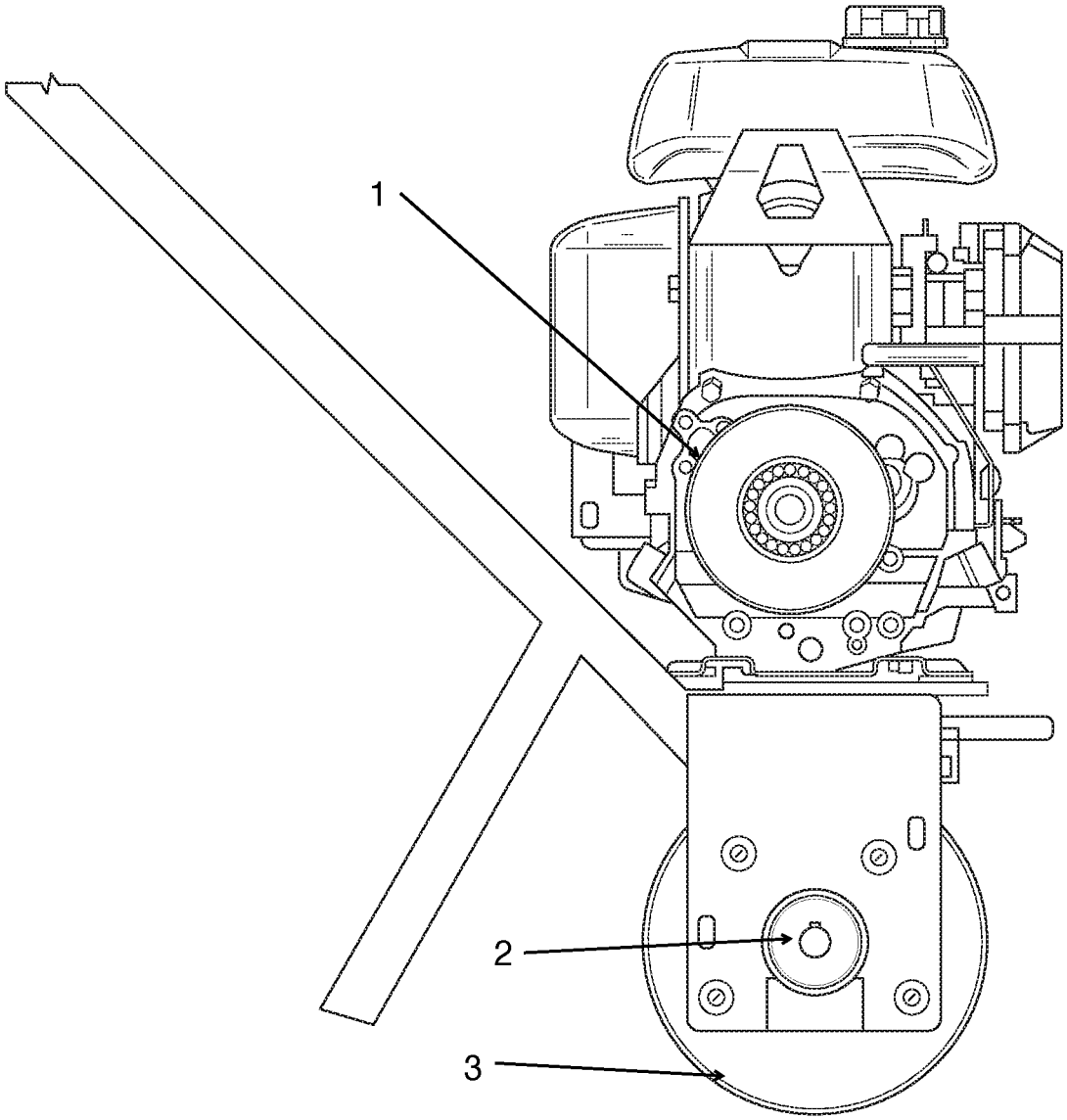
FIG. 3 is a side elevational view of a prior art machine.

In FIG. 3, shows a known walk-behind vibratory roller. Specifically, the entire unit weighs roughly 100 pounds and compacts with about 1600 pounds of force. When in use, the unit is "self-propelled" in that the drum rotates "forward" and rolls the unit along the ground if not held onto. Throughout the report we refer to the movement of the unit as "forward" or "reverse" direction. Rotation directions of various components below clarifies the direction of rotation of the drum and movement of the unit as compared to the orientation for the unit shown in FIG. 3. The forward direction would be rolling to the right in FIG. 3.

Inside the oval-shaped, black belt guard, the engine rotates a pulley above the drum that is connected by a V-belt to the eccentric pulley at the center of the drum. Both the engine pulley and the eccentric shaft rotate counterclockwise (CCW) as viewed from the right side of the unit. However, neither the engine nor the eccentric shaft force the drum to rotate. The drum rotates clockwise (CW), moving the unit forward, due to an interaction with the ground. On the other hand, when the drum is raised in the air, it rotates CCW due to a small torque from bearing friction.

Figure 4B:
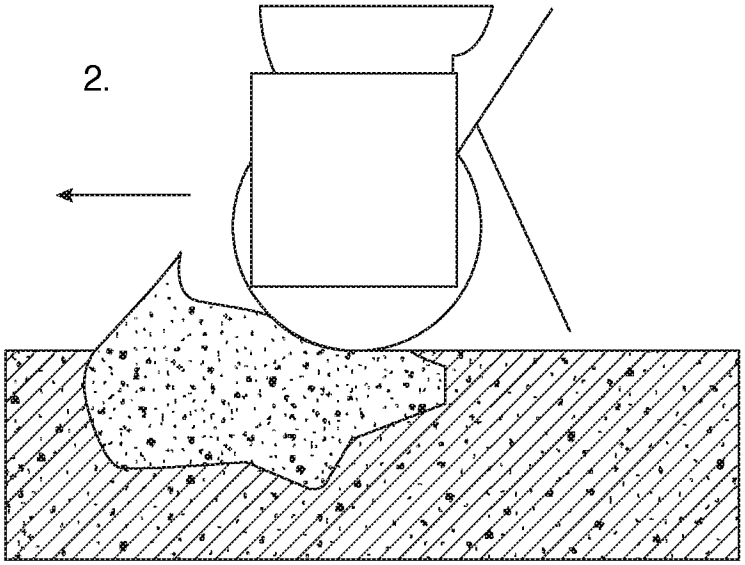
FIGS. 4A and 4B conceptually show packing a pothole.
Figure 4A:
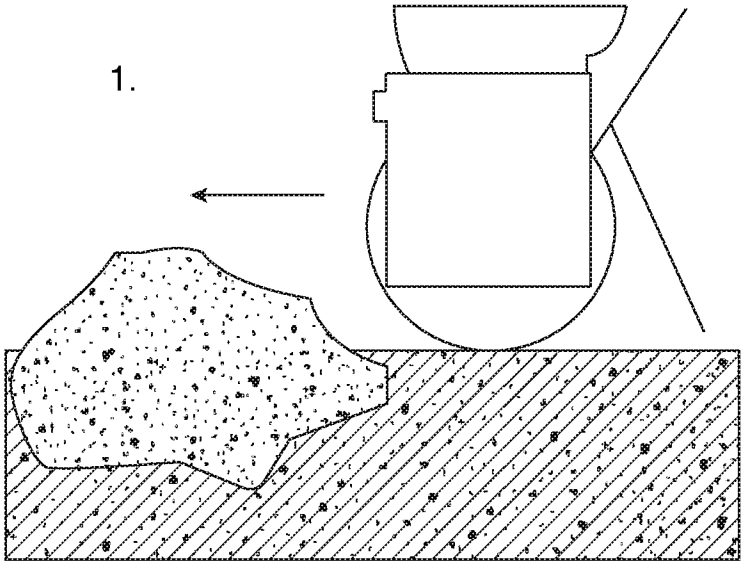
Figure 5:
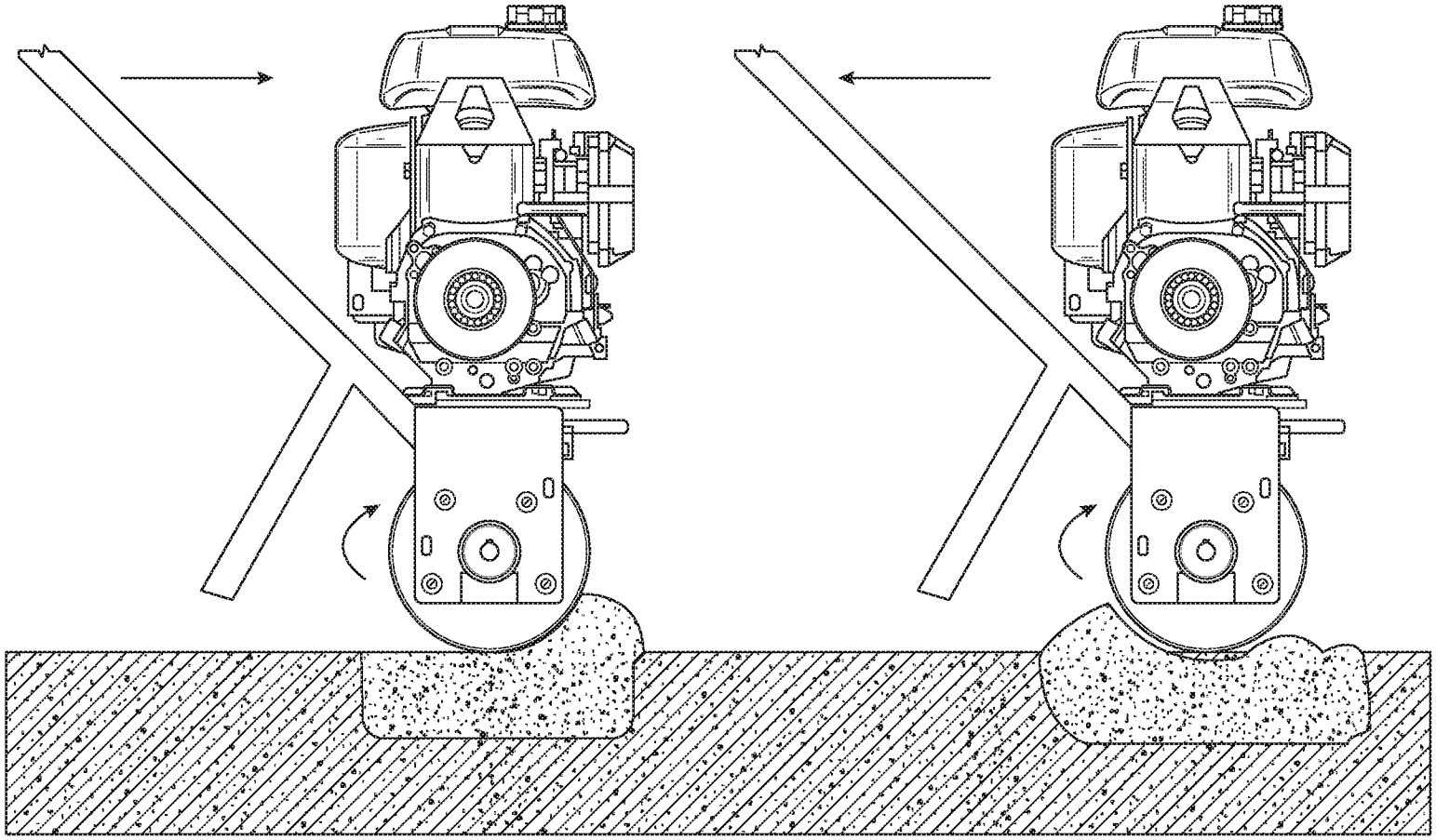
FIG. 5 shows how damage is caused to asphalt when a machine is pulled backwards.

Further, FIGS. 4A and 4B show compacting a pothole with a prior art machine where the user is instructed to mound up the asphalt in the hole, then push the unit forwards over the hole. Once the user reaches the end of the hole they are compacting, they pull the machine backwards. When the unit is being pulled backwards, the drum is still rotating forwards. This makes the process very tiring for the user, and it also tears up the asphalt due to the constant forwards rotation of the drum. When the unit is pulled backwards, the unit wants to jump around which creates divots and bumps in the asphalt. These divots and bumps, if not fixed, will allow water to seep through the asphalt creating more potholes. FIG. 5 depicts how the prior art machine drum tears up the asphalt behind it when pulled backwards over a pothole. This is very undesirable.

Time is essential when using these vibratory pothole packers. There is not enough time to push the unit over the pothole, walk around the bole and push the roller in another direction. Pushing the unit backwards then forwards is the most effective method of using the roller. If the reverse was assisted then the time to patch a pothole will be reduced allowing roads to open faster, reducing the amount of traffic, and aggravated motorists.

Figure 6A:
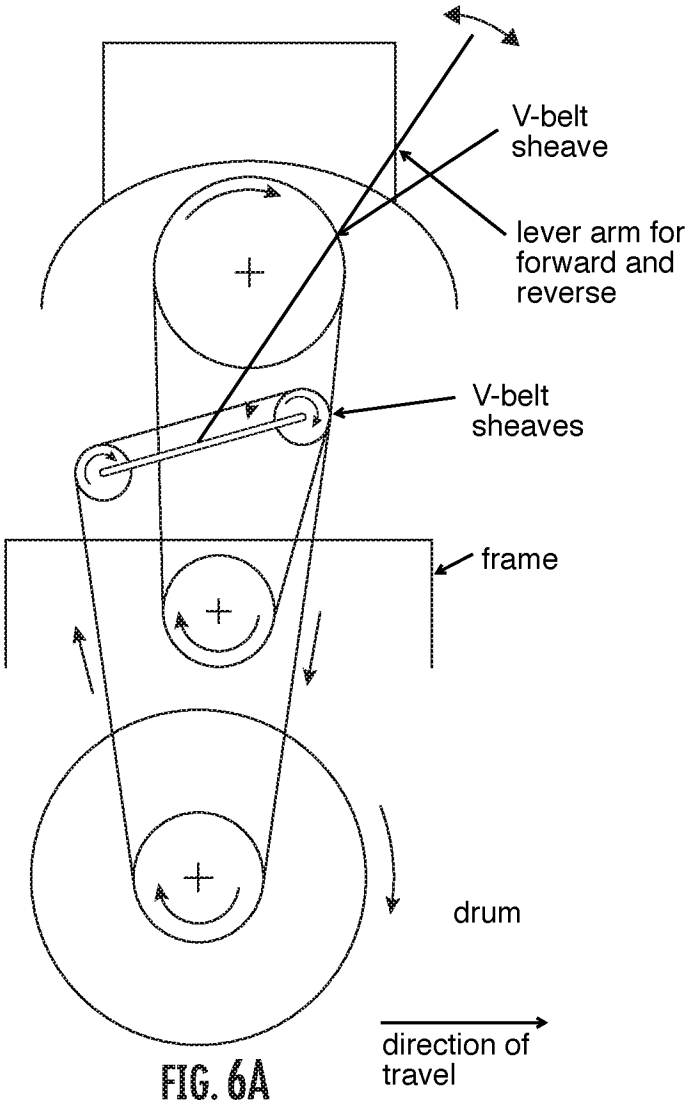
FIGS. 6A and 6B show side views of the present invention.
Figure 6B:
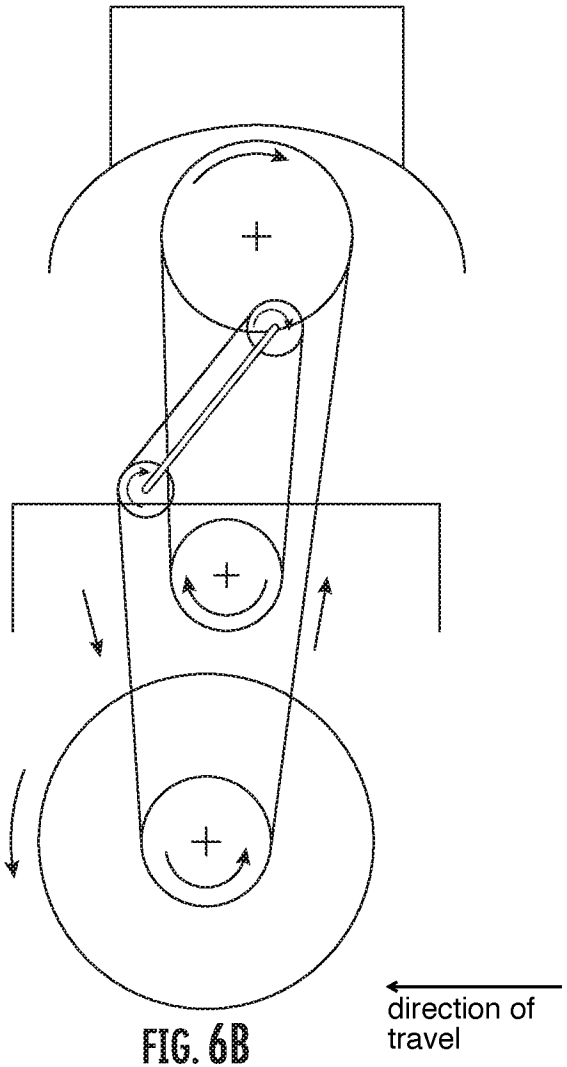

With this problem in mind, the present invention solves the aforementioned problems. The new design of the present invention is self-propelled in both the forward and reverse directions, as seen in FIGS. 6A and 6B of the present invention.

In accordance with the present invention, an additional V-belt is used to create a forwards and reverse rotation of the eccentric shaft, which would create a forwards and backwards movement of the machine.

Figure 7:
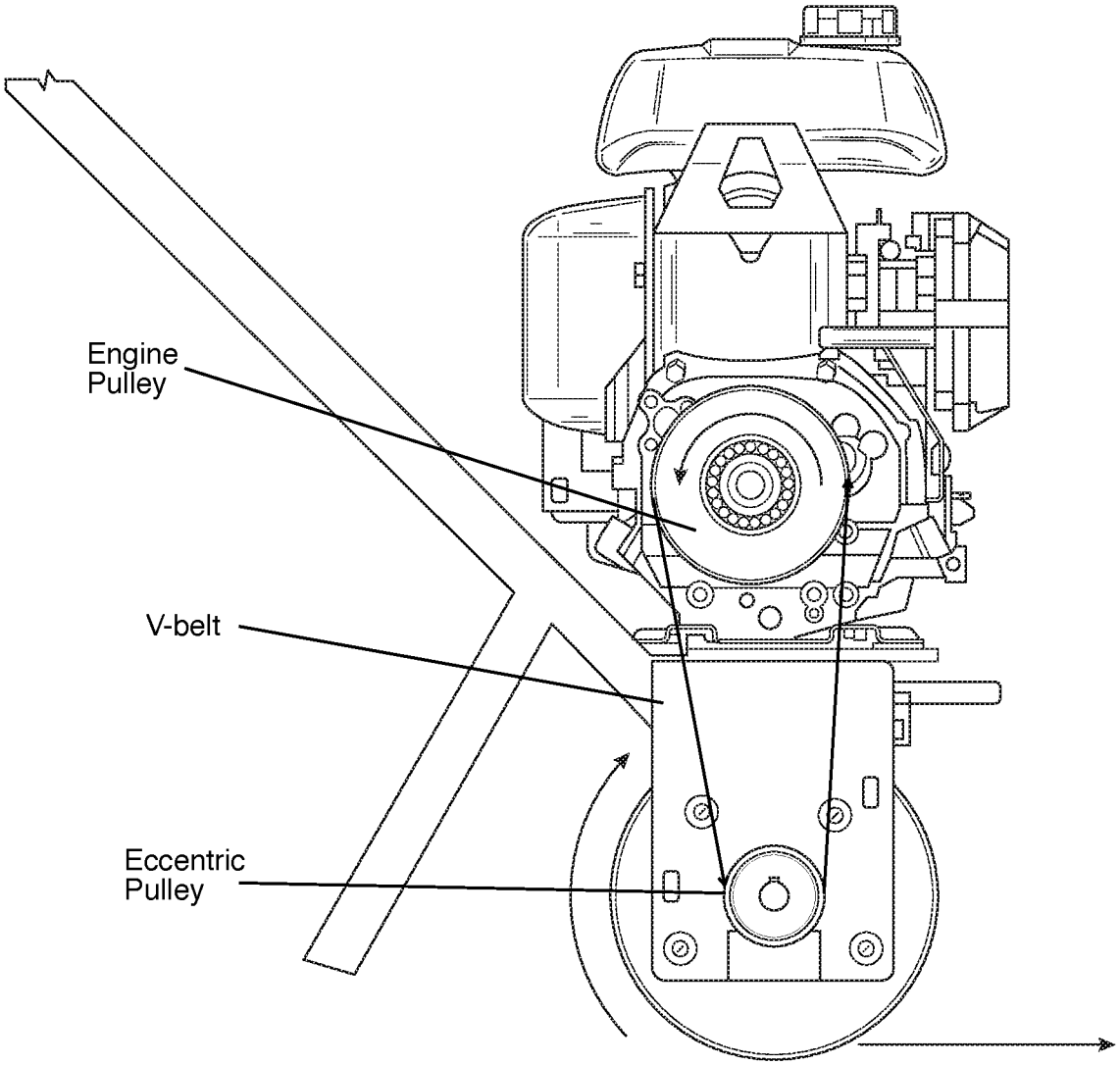
FIG. 7 shows a conceptual view of the theory of forward movement of a machine.

As in FIG. 7, during operation, the drum rolls forward (clockwise) when in contact with the ground, despite the fact that eccentric shaft within the drum rotates backwards (counterclockwise). When the drum is lifted in the air, the drum rolls backwards (counterclockwise), in the same direction as the eccentric shaft. It is the forward rolling force that causes the machine to rip up asphalt when it is pulled backwards.

As the eccentric shaft rotates at a high frequency within the drum, it causes a vibratory force that moves the drum in and out of contact with the ground repeatedly. In the instances that the drum is in contact with the ground, the eccentric shaft is at the bottom of its rotation (meaning the weight is pointed downwards). Due to the shaft's backwards rotation, during these instances of contact with the asphalt, there is a forwards force vector on the unit. Thus, due to the high friction of the asphalt, the drum rotates in the forwards direction, as seen in FIG. 7.

Figure 8B:
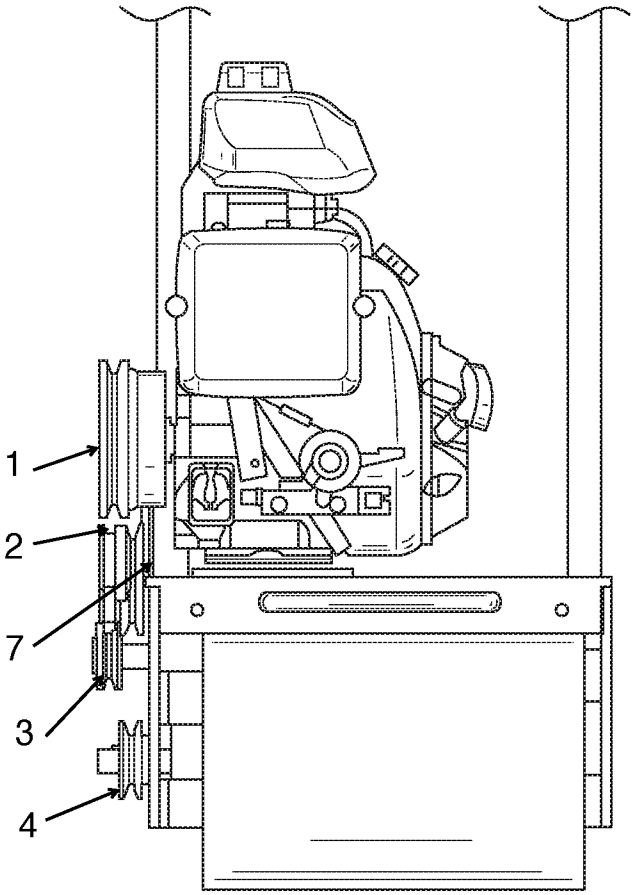
FIGS. 8A and 8B show different view of the present invention.
Figure 8A:
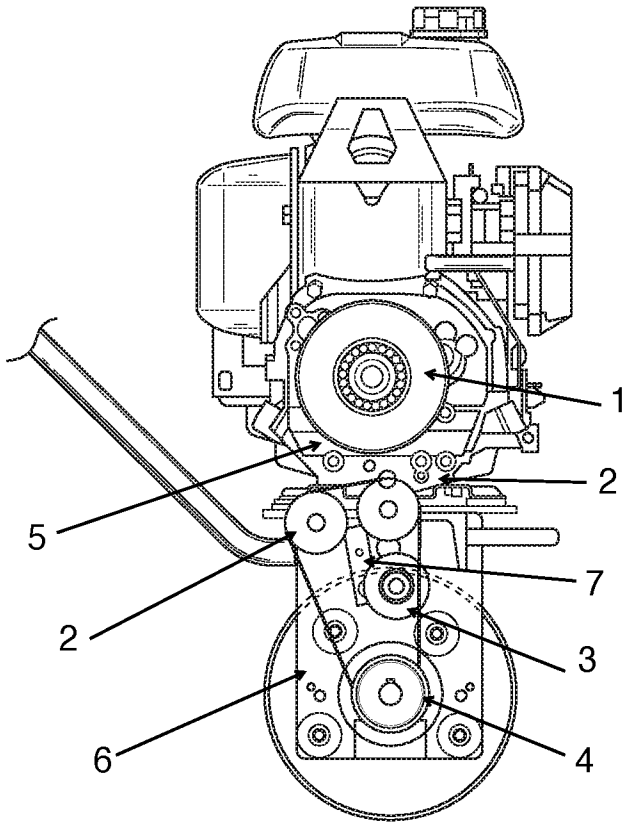

FIGS. 8A and 8B, engine pulley 1, double groove pulley (flat groove and V-belt groove), idler pulley 3, eccentric pulley 4, engine drive V-belt 5, eccentric drive V-belt 6 and linkage 7 connecting the two double groove pulleys 2 are provided and shown.

The new design of the present invention uses a Y-belt that connects the engine pulley to an idler pulley on the frame 5. It also uses two additional pulleys 2 that connect to the eccentric pulley 4 using another V-belt 6. These two pulleys are designed to have a flat groove and a V-groove. The V-groove will be used to hold the V-belt that is connected to the eccentric pulley. The flat groove is used to grab the flat side of the engine drive belt. As seen in FIG. 18, the two double grooved pulleys can move backwards and forwards, which allows each double grooved pulley to come in contact with the engine drive V-belt. When the linkage 7 is pushed forwards, the double groove pulley on the left is pushed into contact with the engine drive belt. This will force the double grooved pulleys to rotate clockwise, in turn spinning the eccentric clockwise. This will cause a reverse linear movement of the drum. Similarly, when the linkage is pushed backwards, the double grooved pulley on the right will come in contact with the engine drive pulley. This will create a counterclockwise rotation of the eccentric shaft, which will create a forwards linear direction of the unit. This can be seen in FIGS. 9A and 9B.

Figure 9B:
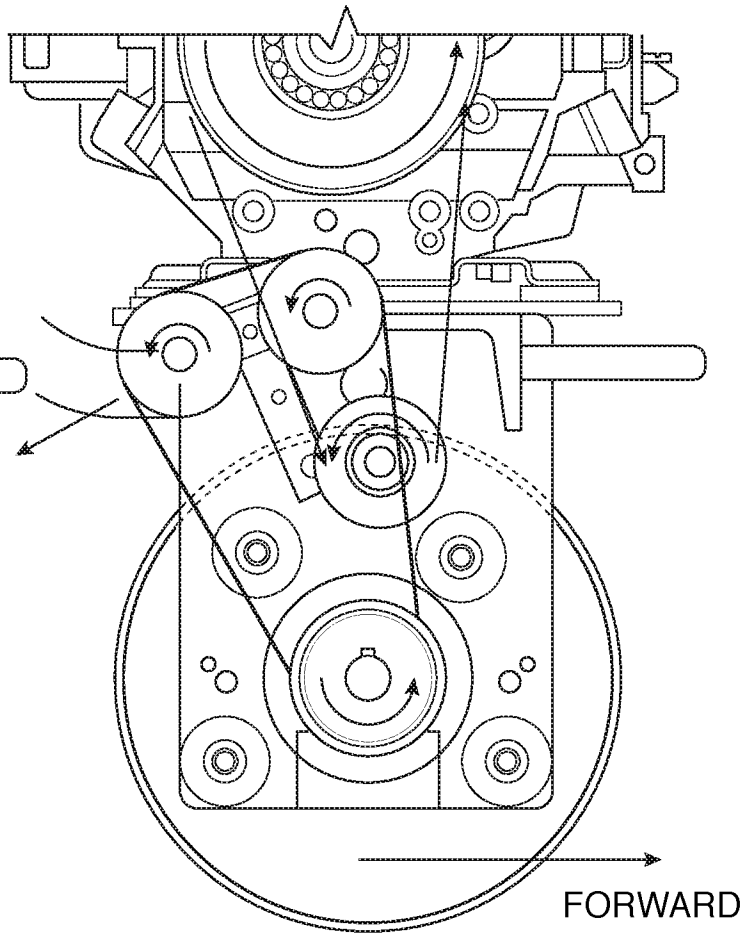
FIGS. 9A and 9B show different view of the operation of the present invention.
Figure 9A:
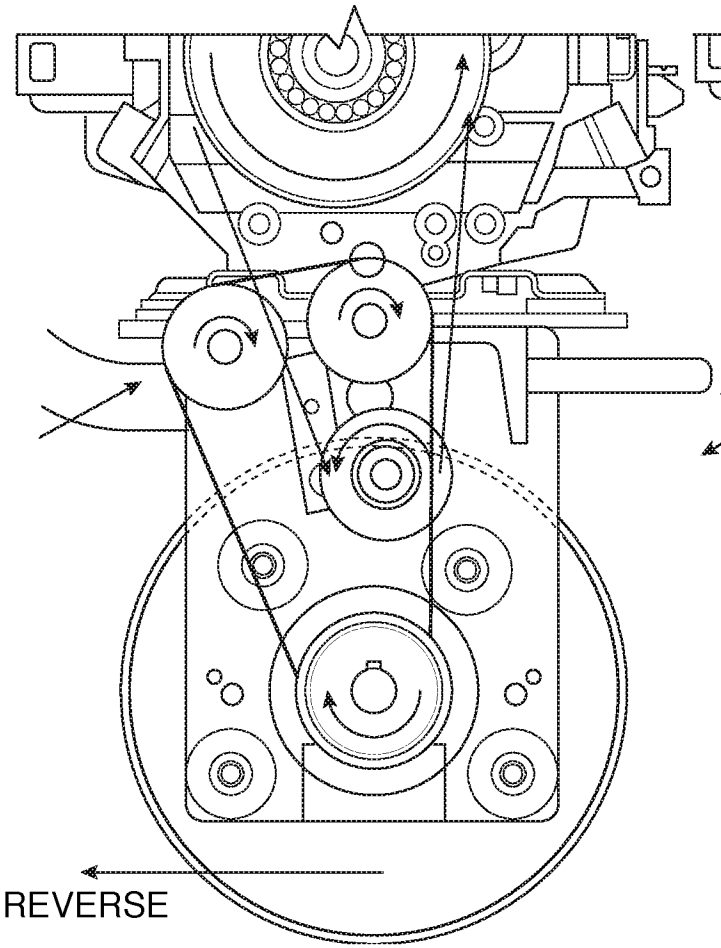

As seen in FIGS. 9A and 9B, the double groove pulley needs a flat groove in order to properly transmit power from the engine drive belt (shown as red lines). If it was a double V-groove, the belt engine drive belt would wear out very quickly on the double groove pulley. It should be noted that these drawings are not fully completed. FIGS. 9A and 9B also show how the two double grooved pulleys are never perfectly horizontal.

This is very important for the design because the tensions in the eccentric drive belt (shown as blue lines) will force the pulleys to default to the forwards drive position. Although no gear changing mechanism has been designed yet, it is important that the pulleys will default to a forwards drive position. When compacting a pothole with the GR unit, the user will go over the pothole in a forwards direction then pull it backwards quickly. Since the pulleys default to a forwards drive direction, the user will have a much easier time controlling the unit. It should be noted that the drawings above are preliminary, and were used to prove out an idea using 3D modeling. For each drive position, there needs to be a stopping point to ensure the linkage does not travel too far, which could be dangerous or damage the machine. The team still needs to determine bow these pulleys will be mounted to allow for an easy and quick way to change directions. The mechanism to change directions also needs to be discussed with the Industrial Engineers to determine the best ergonomical way to do so. It is also possible to use a double clutch mechanism on the engine shaft to create a forwards and reverse direction.

Figure 10B:
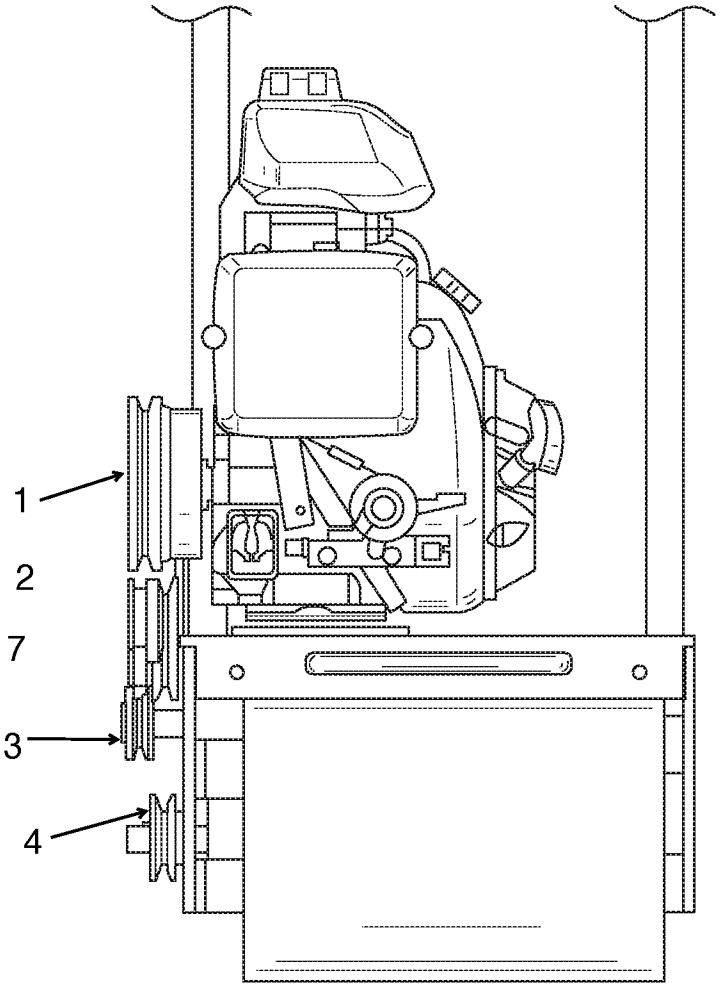
FIGS. 10A and 10B show further details of the present invention.
Figure 10A:
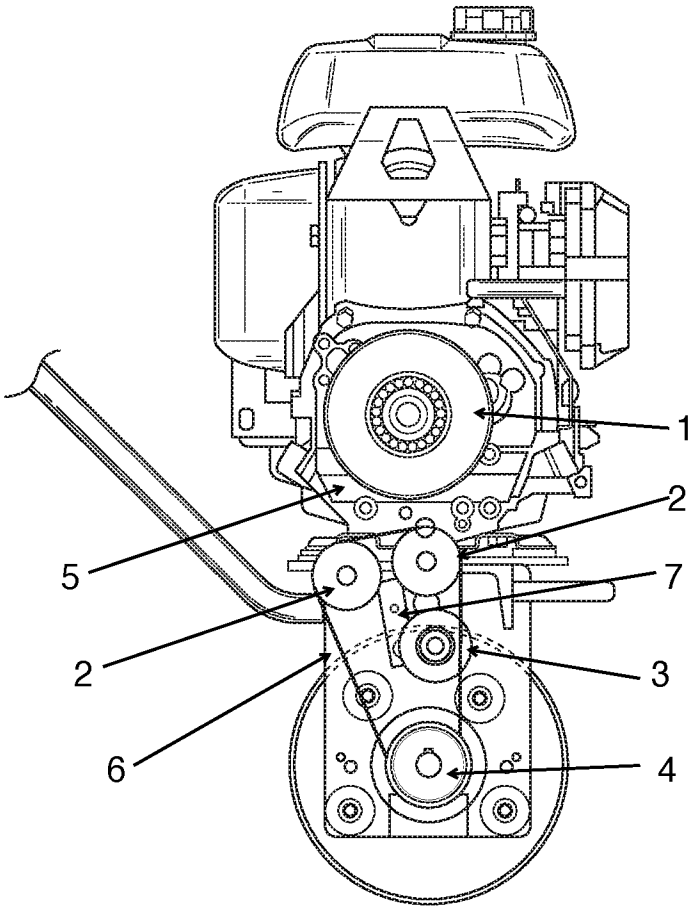

In FIGS. 10A and 10B, engine pulley 1, double groove pulley (flat groove and V-belt groove), idler pulley 3, eccentric pulley 4, engine drive V-belt 5, eccentric drive V-belt 6 and linkage 7 connecting the two double groove pulleys 2 are provided and shown.

Figure 11B:
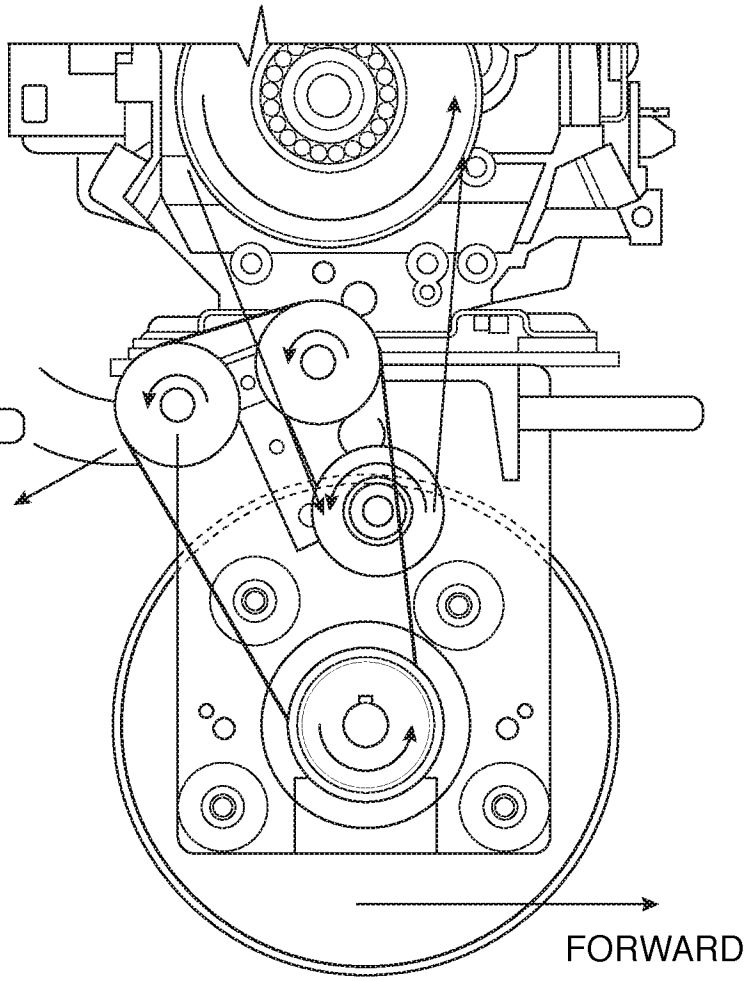
FIGS. 11A and 11B show forward and rearward movement of the present invention.
Figure 11A:
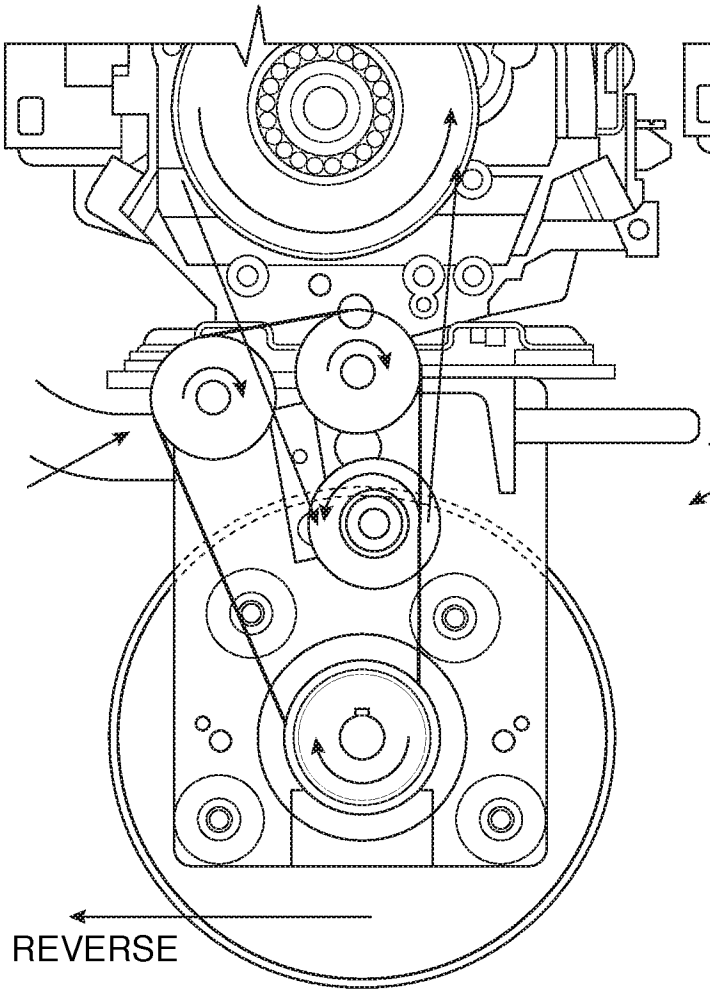

In FIGS. 11A and 11B, when the two double grooved pulleys 2 are rotated on the linkage 7 they will come into contact with the engine drive belt 5, which will change the rotation direction of the two double pulleys which changes the direction of the eccentric shaft pulley 4. Depending on if the linkage is pushed forwards or pulled backwards will make the eccentric pulley rotate clockwise (creating a reverse linear movement of the unit) or counterclockwise (creating a forward linear movement of the unit), respectively.

Figure 12:
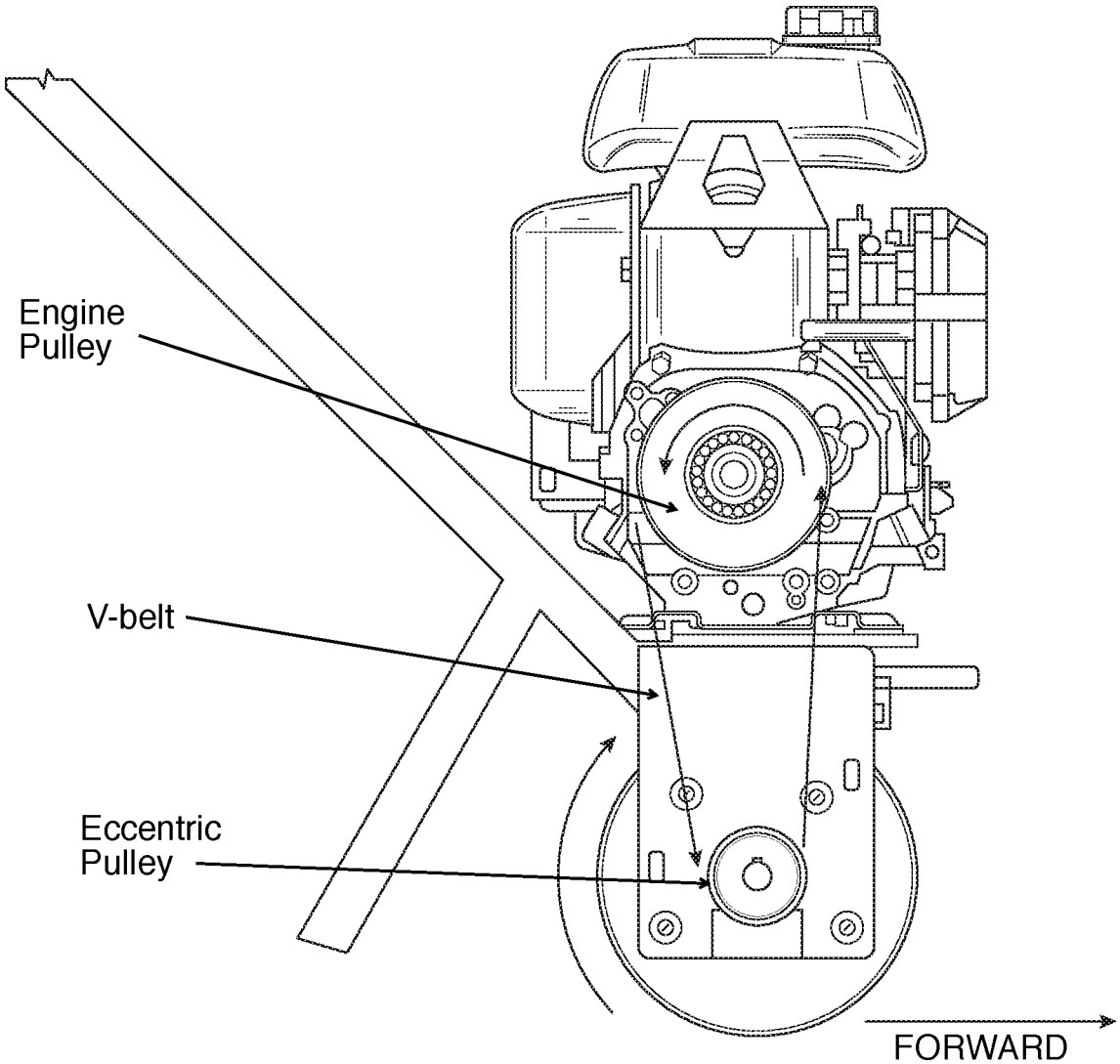
FIG. 12 illustrates operation of the engine pulley, eccentric pulley and drum.

In FIG. 12, the engine pulley and the eccentric shaft is spinning clockwise which generates momentum and pushed the GR unit forwards. The rotation of the engine pulley and eccentric shaft, as well as the linear motion of the current GR unit can be seen in FIG. 12.

In sum, the vibratory roller discussed in this document is operated by a single person and is a walk behind unit. The forwards and reversible vibratory roller is propelled in each respective direction solely based on the direction of the rotation of the eccentric element shaft. In the other document attached. As above, FIGS. 9A and 9B depict how pulleys and linkages will change the direction of rotation of the eccentric element shaft. When the eccentric element rotates in a clockwise direction, the drum will rotate in a counter clockwise direction. This creates the reverse direction of the unit. When the eccentric shaft rotates in the counter clockwise direction, the drum will be propelled forwards. This is counterintuitive as it is the opposite direction that the driven pulley is rotating. If the unit is run with the drum in the air, the eccentric shaft rotates counter clockwise. As a solid body this means the bottom point of the drum is also moving in a small counter clockwise circle (due to the amplitude of the eccentric shaft). When the drum contacts the ground, friction between the ground creates a force in the opposite direction. This friction causes the drum to rotate clockwise and roll in the forward direction.

By changing the direction of rotation of the eccentric shaft, the linear motion of the unit will reverse as a result. This will make the unit easier to use, and easier to patch potholes with.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A forward and reversible self-propelled vibratory pothole packer, comprising:

a drum;

a rotatable eccentric element shaft disposed within the drum; and a plurality of pulleys and linkages connected to the shaft, the pulleys and linkages changing the direction of the shaft;

wherein clockwise direction rotation of the shaft causes the drum to rotate in a counter clockwise direction thereby providing reverse direction of the unit as a function of an angular velocity of the shaft;

wherein counter-clockwise rotation of the shaft causes the drum to be propelled forwards as a function of the angular velocity of the shaft;

wherein rotation of the eccentric element shaft creates a vibratory force on the drum; and wherein the drum is not driven directly by the engine.

2. The pothole packer of claim 1, wherein the shaft is concentric with the drum.

3. The pothole packer of claim 1, wherein the shaft is supported within the drum with bearings.

4. The pothole packer of claim 3, wherein the bearings are pressed into the drum.

5. The pothole packer of claim 1, wherein the drum is self-propelled in both the forward and reverse directions.

6. The pothole packer of claim 1, further comprising, two double groove pulleys, and a linkage disposed on the packer connecting the two double groove pulleys, wherein in a first configuration of the linkage, the packer is driven forwards and in a second configuration of the linkage, the packer is driven in reverse.

7. The pothole packer of claim 6, wherein the two double groove pulleys include a first flat groove and a second V-belt groove.

* * * * *